United States Patent [19]

Hoffman

[11] Patent Number: 4,704,758

[45] Date of Patent: Nov. 10, 1987

[54] HANDLE CONSTRUCTION FOR LONG HANDLED IMPLEMENTS

[76] Inventor: Charles W. Hoffman, 305 Hubbard Road, Lynnwood, Wash. 98036

[21] Appl. No.: 889,712

[22] Filed: Jul. 28, 1986

[51] Int. Cl.[4] ..... A46B 5/02

[52] U.S. Cl. ..... 15/144 B; 15/143 R; 15/145; 16/110 R; 56/400.18; 56/DIG. 18; 294/57

[58] Field of Search ..... 15/143 R, 143 B, 144 R, 15/144 B, 145, 146, 159 R, DIG. 10; 294/57; 16/110 R, 115; 56/400.01, 400.17, 400.18, DIG. 12, DIG. 18

[56] References Cited

U.S. PATENT DOCUMENTS

| | | | |
|---|---|---|---|
| 2,430,802 | 11/1947 | Catlin . | |
| 2,536,607 | 1/1951 | Jenkins | 56/400.17 |
| 3,078,604 | 2/1963 | Neuman . | |
| 3,436,111 | 4/1969 | England . | |
| 3,466,078 | 9/1969 | Sholund . | |

FOREIGN PATENT DOCUMENTS

| | | | |
|---|---|---|---|
| 894837 | 10/1953 | Fed. Rep. of Germany | 15/144 R |
| 2465568 | 4/1981 | France | 15/143 R |
| 686252 | 1/1953 | United Kingdom | 15/144 B |

*Primary Examiner*—Edward L. Roberts
*Attorney, Agent, or Firm*—Henderson & Sturm

[57] ABSTRACT

This invention involves an adjustable handle and implement head assembly (10), wherein the handle unit (11) of the assembly (10) is provided with a pair of offset and generally parallel hand grip portions (14) and an elongated shaft member (16) attached to the lower hand grip portions (14) and disposed at an angle of approximately 45° thereto; wherein, the handle unit (11) and its associated implement head unit (12) are vertically adjustable relative to one another.

3 Claims, 4 Drawing Figures

FIG. 1.
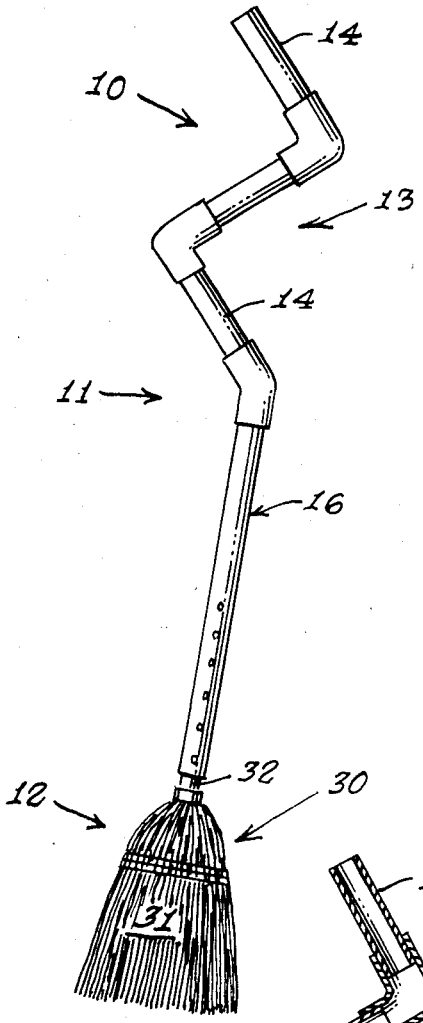
FIG. 2.
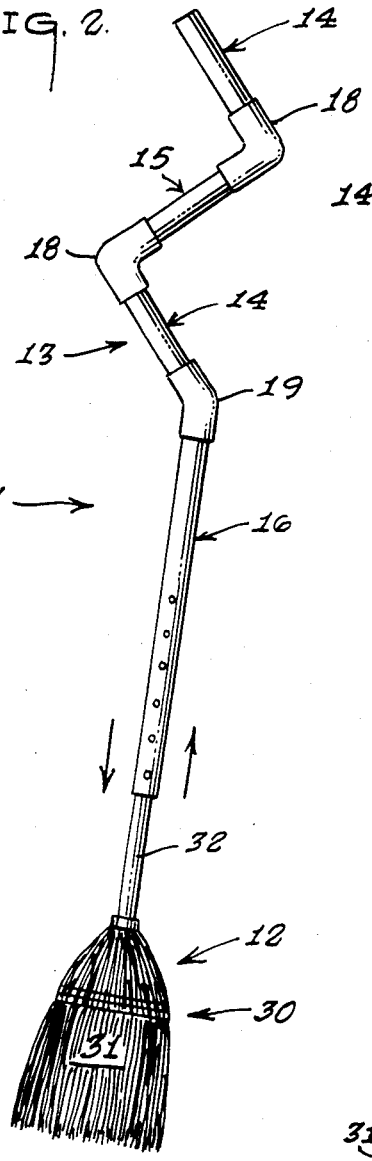
FIG. 3.
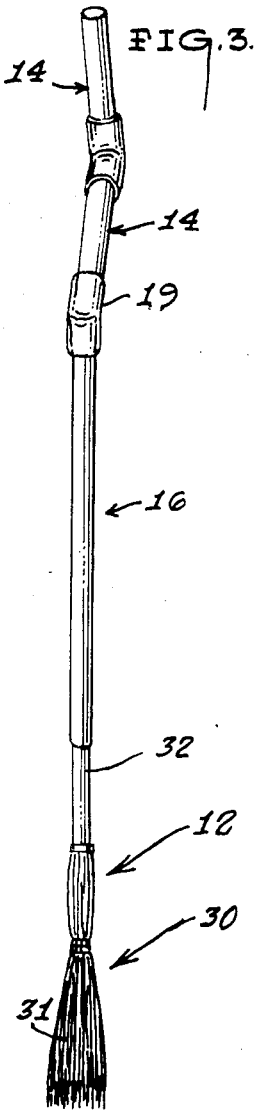
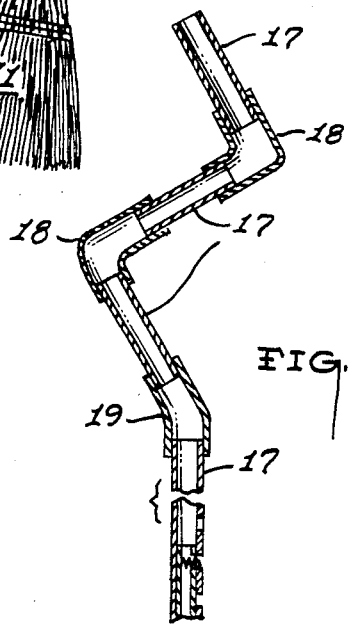
FIG. 4.

HANDLE CONSTRUCTION FOR LONG HANDLED IMPLEMENTS

TECHNICAL FIELD

The present invention relates generally to the field of handle constructions and more specifically to adjustable handle constructions for long handled implements.

BACKGROUND OF THE INVENTION

The prior art is replete with myriad handle constructions for diverse long handled implements such as shovels, lifting tools and the like; as can be seen by reference to the following U.S. Pat. Nos.: 3,436,111; 3,078,604; 3,466,078; and, 2,430,802.

While all of the prior art constructions are adequate for their intended purpose and function, the various handle constructions are also normally restricted from a utilitarian standpoint to the specific task for which they had been developed.

What is surprising therefore is that in light of the fact that broom handles represent one of the oldest types of long handled implement constructions, there has been very little if any development or evolution of the broom handle away from the straight handled approach with which everyone is familiar.

What is also surprising is the fact that given the application of forces that are employed in the act of sweeping, that up until the development of the present invention, no one had devised a broom handle construction that would allow the users hands to assume the ideal position to impart the maximum amount of power to the broom head during the entire power stroke of the handle.

BRIEF SUMMARY OF THE INVENTION

The present invention evolved from a recognition that during the sweeping motion, the users hands naturally try to assume a position that is prohibited by the straight line configuration of the standard broom handle constructions found in everyday use.

It was further recognized that the tendency of the users hands to attempt to assume this position occured at the peak of the power stroke of the broom head.

As can be seen by reference to any broom head that has been exposed to extended usage, the bristles of the broom head exhibit pronounced wear on one side. This wear is directly attributable to the generally arcuate application of pressure one the broom head, which is an inherent by product of the straight handled configuration and the motion employed in the act of sweeping.

By now it should be apparent that the position, that the users hands try to assume during the sweeping motion, is with the users hands at an angle of approximately 45° with respect to the longitudinal axis of a straight handled broom.

It was also recognized that by providing a broom handle construction that would accommodate this natural tendency of the users hands to assume a given position: the application of force employed in sweeping could be more evenly distributed over the sweeping stroke resulting in more uniform wear of the broom head bristles; and, the amount of energy expended by a person using this handle construction would be significantly less than the energy required with a straight handled construction.

This invention also recognized the fact that uneven wear would still be experienced by the broom handle bristles albeit at a slower rate than with the prior art constructions; and, to offset this wear factor the handle and broom head were designed to be relatively rotatable with respect to one another, whereby the side of the broom head showing the greatest amount of wear could be shifted from the inboard to the outboard portion of the broom assembly.

BRIEF DESCRIPTION OF THE DRAWINGS

These and other objects, advantages and novel features of the invention will become apparent from the detailed description of the best mode for carrying out the preferred embodiment of the invention which follows, particularly when considered in conjunction with the accompanying drawings, wherein:

FIG. 1 is a side elevation view of the broom assembly showing the handle in its retracted mode;

FIG. 2 is a side elevation view of the broom assembly showing the handle in its extended mode;

FIG. 3 is a perspective view of the broom assembly; and,

FIG. 4 is a cross-sectional detailed view of the cooperating portions of the broom assembly.

BEST MODE FOR CARRYING OUT THE INVENTION

As can be seen by reference to the drawings and in particular to FIG. 1 the broom assembly which is representative of the basic concept of this invention is designated generally by the reference numeral (10). The broom assembly (10) comprises in general a handle unit (11) and an implement head unit (12).

At this point it should be noted that while the specification and drawings describe and show the handle unit (11) employed in conjunction with a broom head, this invention comtemplates the use of the handle unit in combination with a variety of implement heads such as rakes, hoes, paint rollers, paddles, and the like.

As can best be seen by reference to FIGS. 1 and 2, the handle unit (11) is adjustable relative to the implement head unit (12); and; these units will now be described in seriatim fashion.

The handle unit (11) comprises a generally tubular handle member (13) provided with a pair of generally parallel hand grip portions (14), which are off-set and spaced from one another by an intermediate handle portion (15), which is disposed generally perpendicular to the axial length of the hand grip portions (14).

The handle unit (11) also comprises a generally elongated hollow shaft member, (16) which is operatively connected to the lower hand grip portion (14), and disposed at an angle of approximately 45° with respect thereto.

As can best be seen by reference to FIG. 4 the handle unit (11) of the preferred embodiment comprises lengths of PVC tubing (17), or the like, which are joined together by 90° and 45° connector collar elements (18) and (19) to arrive at the desired handle configuration. It should also be appreciated that the particular materials and methods employed in practicing this invention are not to be restricted to the materials as set forth herein; in as much as, the invention resides in the unique configuration of the handle unit (11) and the cooperation of the handle unit (11) and the implement head unit (12), which will be described presently.

As shown in FIGS. 1 and 2, the shaft member (16) of the handle unit (11) is provided with a plurality of vertically aligned apertures (20) which cooperate with releasable securing means (40) provided on the implement head unit (12) for releasably and adjustably positioning the handle unit (11) relative to the implement head unit (12).

The implement head unit (12) comprises a head element (30) such as a broom head (31) or the like, wherein the head element (30) is provided with an elongated narrow stem member (32) dimensioned to be slidably received within the apertured end of the handle shaft member (16).

The upper portion of the stem member (32) is further provided with the aforementioned releasable securing means (40), which comprises a spring biased detent member (41) that may be selectively engaged with the vertically aligned apertures (20) in the handle shaft member (16) to vary the effective length of the assembly (10).

It should further be noted that, in instances wherein it is contemplated to rotate the head element (30) relative to the handle shaft member (16) to compensate for uneven wear of the head element (30); the handle shaft member (16) is provided with a plurality of diametreically opposed vertically aligned apertures (20), which will receive the detent member (41) on opposite sides of the shaft member (16) to accommodate the rotation of the head element.

As shown in the drawings the hand grip portions (14) of the handle unit (11) are disposed parallel to one another, and at an angle of approximately 45° with respect to the handle shaft member (16). This arrangement not only allows a users hands to assume the most comfortable position while using the assembly (10); but, also allows an alternating push-pull action on the hand grip portions (14) to effect the desired arc of the implement head (30) during the act of sweeping.

Having thereby described the subject matter of this invention it should be obvious that many substitutions, modifications and variations of the invention are possible in light of the above teachings. It is therefore to be understood that the invention as taught and described herein, is only to be limited to the extent of the breadth and scope of the appended claims.

I claim:

1. An adjustable handle and implement head assembly comprising:

a handle unit comprising a handle member having a pair of offset and generally parallel hand grip portions defining an upper and lower portion an elongated hollow shaft member attached to the lower hand grip portion and disposed at an angle of approximately 45° with respect thereto;

an implement head unit comprising a head member provided with an elongated narrow stem member that is dimensioned to be received within said hollow shaft member; and, releasable securing means for selectively and adjustably securing the implement head unit to the handle unit.

2. The assembly as in claim 1; wherein the handle unit further comprises:

an intermediate handle portion connecting said handle grip portions and disposed at an angle of approximately 90° with respect to each of said handle grip portions.

3. The assembly as in claim 2; wherein the releasable securing means comprises:

a plurality of vertically aligned apertures in said hollow shaft member; and, a spring biased detent member disposed on the upper portion of the said stem member, and operatively associated with said plurality of vertically aligned apertures in the hollow shaft member for selectively positioning the handle unit relative to the implement head unit.

* * * * *